US011268308B1

(12) United States Patent
Wernlund et al.

(10) Patent No.: US 11,268,308 B1
(45) Date of Patent: Mar. 8, 2022

(54) FENESTRATION LOCK ASSEMBLIES AND METHODS

(71) Applicant: ANDERSEN CORPORATION, Bayport, MN (US)

(72) Inventors: Chad Wernlund, Baldwin, WI (US); David D. Plummer, Hudson, WI (US)

(73) Assignee: Andersen Corporation, Bayport, MN (US)

( * ) Notice: Subject to any disclaimer, the term of this patent is extended or adjusted under 35 U.S.C. 154(b) by 821 days.

(21) Appl. No.: 16/154,895

(22) Filed: Oct. 9, 2018

Related U.S. Application Data

(60) Provisional application No. 62/570,260, filed on Oct. 10, 2017.

(51) Int. Cl.
*E05C 3/16* (2006.01)
*E05B 65/08* (2006.01)
(Continued)

(52) U.S. Cl.
CPC ..... *E05C 3/162* (2013.01); *E05B 47/0012* (2013.01); *E05B 65/0841* (2013.01); *E05C 3/004* (2013.01); *E05B 2047/0021* (2013.01)

(58) Field of Classification Search
CPC . E05C 3/162; E05C 3/004; E05C 3/02; E05C 3/04; E05C 3/041; E05C 3/044; E05C 3/046; E05C 3/12; E05C 3/16; E05C 3/167; E05C 9/002; E05C 9/04; E05C 9/042; E05C 9/043; E05C 9/10; E05C 9/14; E05C 9/16; E05B 65/0841; E05B 2047/0021; E05B 47/00; E05B 47/0001; E05B 47/0012; E05B 2047/002; E05B 2047/0024; E05B 2047/0025; E05B 2047/0036; E05B 65/08; E05B 65/0811; E05B 65/0823; E05B 65/0835; E05B 65/087; E05B 65/0876; E05B 2065/0805; Y10T 292/0837; Y10T 292/0838; Y10T 292/084; Y10T 292/0841; Y10T 292/0844; Y10T 292/0845; Y10T 292/0851; Y10T 292/0854;
(Continued)

(56) References Cited

U.S. PATENT DOCUMENTS 3,811,718 A 5/1974 Bates
4,095,829 A 6/1978 Van Klompenburg
(Continued)

FOREIGN PATENT DOCUMENTS

DE 102010032995 A1 * 2/2012 ..... E05B 47/0012
EP 1777508 A2 * 4/2007 ..... E05B 81/06
(Continued)

*Primary Examiner* — Kristina R Fulton
*Assistant Examiner* — Steven A Tullia
(74) *Attorney, Agent, or Firm* — Mueting Raasch Group

(57) ABSTRACT

Fenestration lock assemblies, fenestration units including the lock assemblies, and methods of operating the lock assemblies. The lock assemblies offer a lock assembly construction that is capable of being assembled, installed, and used in a purely manual mode (i.e., in the absence of any driving unit such as, e.g., a motor, solenoid, etc.) or that may be assembled, installed, and used with a driving unit such that the lock assembly can be operated manually or in a driven mode, with the manual and driven modes of operation being unaffected by each other.

24 Claims, 13 Drawing Sheets

(51) Int. Cl.
*E05B 47/00* (2006.01)
*E05C 3/00* (2006.01)

(58) Field of Classification Search
CPC ..... Y10T 292/0855; Y10T 292/0856; Y10T 292/0843; Y10T 292/0857; Y10T 292/0859; Y10T 292/1039; Y10T 292/1041; Y10T 292/1082; Y10T 292/108; Y10T 292/1083; Y10T 292/1092; Y10T 292/1084; Y10T 292/1021; Y10S 292/20; Y10S 292/25; Y10S 292/46; Y10S 292/47
USPC ..... 49/449, 358
See application file for complete search history.

(56) References Cited

U.S. PATENT DOCUMENTS 4,497,135 A 2/1985 Vetter
4,703,960 A * 11/1987 Lense ..... E05B 47/0012 292/192
5,493,813 A 2/1996 Vetter et al.
5,582,445 A 12/1996 Olsen et al.
5,715,631 A * 2/1998 Kailian ..... E05B 65/0876 292/172
6,139,070 A * 10/2000 Piltingsrud ..... E05B 17/0029 292/144
6,412,834 B1 7/2002 Waitai et al.
6,588,150 B1 * 7/2003 Wong ..... E05B 53/003 49/183
6,877,784 B2 4/2005 Kelley et al.
7,013,603 B2 3/2006 Eenigenburg et al.
7,070,211 B2 7/2006 Polowinczak et al.
7,322,619 B2 1/2008 Nolte et al.
7,607,262 B2 10/2009 Pettit et al.
7,770,943 B2 * 8/2010 Kaiser ..... E05B 17/20 292/144
7,963,577 B2 6/2011 Wolf
8,002,317 B2 8/2011 Satram et al.
8,269,627 B2 9/2012 Gore et al.
9,163,437 B1 * 10/2015 Lawrence ..... E05B 65/1033
2002/0060458 A1 * 5/2002 Roatis ..... E05B 47/023 292/199
2002/0116874 A1 * 8/2002 Marshik ..... E05B 65/0835 49/183
2003/0071471 A1 * 4/2003 Lu ..... E05B 47/0012 292/144
2003/0205903 A1 * 11/2003 Kelley ..... E05C 9/1833 292/241
2004/0026932 A1 * 2/2004 Coleman ..... E05B 17/2003 292/241
2008/0022728 A1 * 1/2008 Flory ..... E05B 63/14 70/90
2009/0079202 A1 * 3/2009 Wolf ..... E05C 9/002 292/36
2009/0211320 A1 * 8/2009 Wu ..... E05B 47/0012 70/277
2015/0211260 A1 * 7/2015 Chen ..... E05B 47/026 74/625
2016/0069108 A1 * 3/2016 Liang ..... E06B 9/02 292/165
2016/0356059 A1 * 12/2016 Newman ..... E05B 47/0012

FOREIGN PATENT DOCUMENTS

EP 2813647 A1 * 12/2014 ..... E05B 47/0012
JP 2000310068 A * 11/2000
JP 2002138752 A * 5/2002
JP 2004238849 A * 8/2004
JP 2013221299 A * 10/2013
KR 20090028245 A * 3/2009
WO WO-2017199936 A1 * 11/2017 ..... E05B 49/00

* cited by examiner

FENESTRATION LOCK ASSEMBLIES AND METHODS

RELATED APPLICATION

This application claims the benefit under 35 U.S.C. Section 119 of U.S. Provisional Patent Application Ser. No. 62/570,260 entitled "FENESTRATION LOCK ASSEMBLIES AND METHODS" and filed on Oct. 10, 2017, which is incorporated herein by reference in its entirety.

Fenestration lock assemblies, fenestration units including the fenestration lock assemblies, and methods of using the same are described herein.

Lock assemblies used in fenestration units are typically designed for either manual or powered/driven operation to move the lock between its locked and unlocked states. The components in manually operated lock assemblies and driven lock assemblies (whether powered by, e.g., a motor, solenoid, etc.) are typically incompatible with each other such that replacing a manually operated lock assembly with a driven lock assembly (or vice versa) typically requires removal and replacement of the entire lock assembly.

Further, in fenestration units designed for use with one or the other of a manually operated lock assembly, replacement of the manually operated lock assembly with a driven lock assembly may be impossible or require undesirable modifications to the fenestration unit itself to accommodate the motor or other components required by the driven lock assembly.

In addition, driven lock assemblies for fenestration units often offer limitations for manual operation. In some cases, driven lock assemblies may not offer the option for manual operation between locked and unlocked states—where "manual operation" as used herein means that the lock assembly includes a component that is physically moved by a user to change the lock assembly between its locked and unlocked states.

In such driven locking assemblies, the loss of power either automatically results in a transition from a locked state to an unlocked state for safety reasons (to allow egress from a building, etc.). That action, however, raises its own safety concerns as unwanted access to a building may be available when the lock is in the unlocked state. To address that problem, some driven lock assemblies incorporate battery backup systems such that power to the lock assemblies can be maintained when power within the structure itself is lost. Even battery backup systems, however, have limitations and when the battery backup system is drained, the driven lock assemblies will typically transition from a locked state to an unlocked state.

In addition, driven lock assemblies that offer both manual and powered operation typically require a user to "back-drive" one or more components of the drive system during manual operation of the lock. In other words, the user must operate the powered components within the drive system, as well as components in the lock mechanism, to move the lock between its locked and unlocked states. As a result, the user is typically required to exert more force to operate the lock than would be required if the lock assembly were not driven.

SUMMARY

Fenestration lock assemblies, fenestration units including the lock assemblies, and methods of operating the lock assemblies are described herein. The lock assemblies as described herein offer a lock assembly construction that is capable of being assembled, installed, and used in a purely manual mode (i.e., in the absence of any driving unit such as, e.g., a motor, solenoid, etc.) or that may be assembled, installed, and used with a driving unit such that the lock assembly can be operated manually or in a driven mode, with the manual and driven modes of operation being unaffected by each other. In other words, the addition of a driving unit to the lock assembly does not require back-driving of the components used to operate the lock assembly in the driven mode in a manner that increases the perceived effort required to operate the lock assembly manually.

In one or more embodiments, the fenestration lock assemblies described herein can be easily retro-fitted to include a driving unit configured to operate the lock assembly in a driven mode through the drive gears of the lock assemblies. In that sense, one or more embodiments of the fenestration lock assemblies can be described as modular because the driving unit (and, optionally, related components such as a power supply, controller, etc.) may be selectively added to the fenestration lock assemblies during, e.g., manufacturing of the fenestration lock assemblies, during installation of the fenestration lock assemblies on/in a fenestration unit, or after installation of the fenestration lock assembly in a fenestration unit (as, e.g., and upgrade to provide for driven operation).

Further, in one or more embodiments, a user operating the fenestration lock assembly may be entirely unaware of the presence of any components used to drive the lock assembly to reduce or eliminate the likelihood of any confusion on the part of the user during manual operation of the lock assembly.

In a first aspect, one or more embodiments of a fenestration lock assembly as described herein may include: a drive shaft defining a drive shaft axis extending between a first end and a second end; a lock member fixedly coupled to the drive shaft proximate the first end of the drive shaft, wherein movement of the lock member between a locked position and an unlocked position rotates the drive shaft over a lock/unlock arc about the drive shaft axis, wherein the lock/unlock arc comprises a first end corresponding to the locked position and a second end corresponding to the unlocked position; a drive gear coupled to the drive shaft between the lock member and the second end of the drive shaft, wherein the drive gear comprises a rotational home position relative to the drive shaft axis; and a lock follower fixedly coupled to the drive shaft between the lock member and the second end of the drive shaft such that the lock follower rotates with the drive shaft, wherein the lock follower comprises a locked configuration corresponding to the locked position of the lock member and an unlocked configuration corresponding to the unlocked position of the lock member; wherein the lock follower and the drive gear are coupled to each other such that, when the drive gear is in the rotational home position and the lock follower is in the locked configuration, rotation of the drive gear in an unlock direction over the lock/unlock arc rotates the lock follower and the drive shaft, wherein the lock follower moves to its unlocked configuration and the lock member moves to its unlocked position; and wherein rotation of the drive shaft and the lock follower about the drive shaft axis between the first end and the second end of the lock/unlock arc does not rotate the drive gear when the drive gear is in the rotational home position.

In one or more embodiments of the fenestration lock assemblies described herein, rotation of the drive gear in the unlock direction over the lock/unlock arc rotates the lock follower to its unlocked configuration and moves the lock member to its unlocked position through rotation of the drive shaft by the lock follower when the lock follower is in its locked configuration and the drive gear is in its rotational home position.

In one or more embodiments of the fenestration lock assemblies described herein, rotation of the drive gear in a lock direction that is opposite the unlock direction over a distance at least as great as the lock/unlock arc rotates the lock follower to its locked configuration and moves the lock member to its locked position through rotation of the drive shaft by the lock follower when the lock follower is in its unlocked configuration and the drive gear is in its rotational home position.

In one or more embodiments of the fenestration lock assemblies described herein, the assembly comprises a controller operably connected to a motor that is operably connected to the drive gear, wherein the controller is configured to operate the motor such that the motor rotates the drive gear about the drive shaft axis. In one or more embodiments, the controller is configured to operate the motor such that the drive gear returns to its rotational home position after motor rotates the drive gear in the unlocking direction over the lock/unlock arc to rotate the lock follower and the drive shaft such that the lock follower moves to its unlocked configuration and the lock member moves to its unlocked position. In one or more embodiments, the controller is configured to operate the motor such that the drive gear returns to its rotational home position after the motor rotates the drive gear in the lock direction to rotate the lock follower to its locked configuration and move the lock member to its locked position through rotation of the drive shaft by the lock follower.

In one or more embodiments of the fenestration lock assemblies described herein, the lock follower comprises a pin and the drive gear comprises an arcuate slot occupying a slot arc at least as large as the lock/unlock arc, and wherein the pin is located in the arcuate slot, wherein the pin moves within the arcuate slot when the lock member is moved between the locked position and the unlocked position and the drive gear is stationary in its rotational home position. In one or more embodiments, rotation of the drive gear in an unlocking direction over the lock/unlock arc moves the arcuate slot and the pin to rotate the lock follower and the drive shaft, wherein the lock follower moves to its unlocked configuration and the lock member moves to its unlocked position when the drive gear is in the rotational home position and the lock follower is in the locked configuration. In one or more embodiments, rotation of the drive gear in a locking direction that is opposite the unlocking direction moves the arcuate slot and the pin to rotate the lock follower and the drive shaft, wherein the lock follower moves to its locked configuration and the lock member moves to its locked position after rotating the drive gear in the unlocking direction over the lock/unlock arc to rotate the lock follower to its unlocked configuration and move the lock member to its unlocked position.

In one or more embodiments of the fenestration lock assemblies described herein, the drive gear comprises a pin and the lock follower comprises an arcuate slot occupying a slot arc at least as large as the lock/unlock arc, and wherein the pin is located in the arcuate slot, wherein the arcuate slot moves along the pin when the lock member is moved between the locked position and the unlocked position and the drive gear is stationary in its rotational home position. In one or more embodiments, rotation of the drive gear in an unlocking direction over the lock/unlock arc moves the arcuate slot and the pin to rotate the lock follower and the drive shaft, wherein the lock follower moves to its unlocked configuration and the lock member moves to its unlocked position when the drive gear is in the rotational home position and the lock follower is in the locked configuration. In one or more embodiments, the lock follower can be moved to its locked configuration and the lock member moved to its locked position by rotating the drive gear in a locking direction that is opposite the unlocking direction such that the pin acts against an end of the arcuate slot to rotate the lock follower to its locked configuration after rotating the drive gear in the unlocking direction over the lock/unlock arc to rotate the lock follower to its unlocked configuration and move the lock member to its unlocked position followed by moving the drive gear to its rotational home position.

In a second aspect, one or more embodiments of a fenestration unit as described herein may include a frame defining opening within the frame; a movable panel mounted in the frame, wherein the movable pane 1 is configured for movement within the frame between a closed position in which the opening is closed, and an open position in which the opening is open; and a fenestration lock assembly as described herein operably attached to the fenestration unit.

In a third aspect, one or more embodiments of the methods of operating a fenestration lock as described herein may include: manually moving the lock member from its locked position to its unlocked position, wherein moving the lock member from its locked position to its unlocked position rotates the drive shaft and the lock follower in an unlock direction about the drive shaft axis between the first end and the second end of the lock/unlock arc while the drive gear remains in its rotational home position, wherein manually moving the lock member from its locked position to its unlocked position moves the lock follower to its unlocked configuration; manually moving the lock member from its unlocked position to its locked position, wherein moving the lock member from its unlocked position to its locked position rotates the drive shaft and the lock follower in a lock direction about the drive shaft axis between the first end and the second end of the lock/unlock arc while the drive gear remains in its rotational home position, wherein manually moving the lock member from its unlocked position to its locked position moves the lock follower to its locked configuration; driving the lock member from its locked position to its unlocked position by driving the drive gear out of its rotational home position in the unlock direction when the lock follower is in its locked configuration, wherein the drive gear is driven using a motor operably coupled to the drive gear, and wherein driving the drive gear out of its rotational home position in the unlock direction rotates the lock follower and the drive shaft in the unlock direction about the drive shaft axis between the first end and the second end of the lock/unlock arc; and driving the lock member from its unlocked position to its locked position by driving the drive gear out of its rotational home position in the lock direction when the lock follower is in its unlocked configuration, wherein the drive gear is driven using a motor operably coupled to the drive gear, and wherein driving the drive gear out of its rotational home position in the lock direction rotates the lock follower and the drive shaft in the lock direction about the drive shaft axis between the first end and the second end of the lock/unlock arc.

In one or more embodiments of the methods described herein, the method further comprises using the motor to drive the drive gear back to its home position after driving the drive gear out of its rotational home position in the unlock direction to drive the lock member from its locked position to its unlocked position. In one or more embodiments, driving the drive gear back to its home position comprises rotating the drive gear in the lock direction.

In one or more embodiments of the methods described herein, the method further comprises using the motor to drive the drive gear back to its home position after driving the drive gear out of its rotational home position in the lock direction to drive the lock member from its unlocked position to its locked position. In one or more embodiments, driving the drive gear back to its home position after driving the drive gear out of its rotational home position in the lock direction to drive the lock member from its unlocked position to its locked position comprises rotating the drive gear in the unlock direction.

In one or more embodiments of the methods described herein, the lock follower comprises a pin and the drive gear comprises an arcuate slot occupying a slot arc at least as large as the lock/unlock arc, and wherein the pin is located in the arcuate slot, wherein manually moving the lock member from the locked position and the unlocked position when the drive gear is stationary in its rotational home position moves the pin within the arcuate slot. In one or more embodiments, driving the drive gear out of its rotational home position in the unlock direction when the drive gear is in the rotational home position and the lock follower is in the locked configuration moves the arcuate slot and the pin to rotate the lock follower to its unlocked configuration. In one or more embodiments, driving the drive gear out of its rotational home position in the lock direction when the drive gear is in the rotational home position and the lock follower is in the unlocked configuration moves the arcuate slot and the pin to rotate the lock follower to its locked configuration.

In one or more embodiments of the methods described herein, the drive gear comprises a pin and the lock follower comprises an arcuate slot occupying a slot arc at least as large as the lock/unlock arc, and wherein the pin is located in the arcuate slot, wherein manually moving the lock member from the locked position and the unlocked position when the drive gear is stationary in its rotational home position moves the arcuate slot about the drive shaft axis while the pin remains in a fixed position relative to the drive shaft axis. In one or more embodiments, driving the drive gear out of its rotational home position in the unlock direction when the drive gear is in the rotational home position and the lock follower is in the locked configuration moves the pin against a first end of the arcuate slot to rotate the lock follower to its unlocked configuration. In one or more embodiments, driving the drive gear out of its rotational home position in the lock direction when the drive gear is in the rotational home position and the lock follower is in the unlocked configuration moves the pin against a second end of the arcuate slot to rotate the lock follower to its locked configuration.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the term "comprises" and variations thereof do not have a limiting meaning where these terms appear in the accompanying description. Moreover, "a," "an," "the," "at least one," and "one or more" are used interchangeably herein.

The above summary is not intended to describe each embodiment or every implementation of the fenestration lock assemblies, fenestration units including the lock assemblies, and methods of operating the fenestration lock assemblies described herein. Rather, a more complete understanding of the invention will become apparent and appreciated by reference to the following Description of Illustrative Embodiments and claims in view of the accompanying figures of the drawing.

DESCRIPTION OF ILLUSTRATIVE EMBODIMENTS

Figure 1:
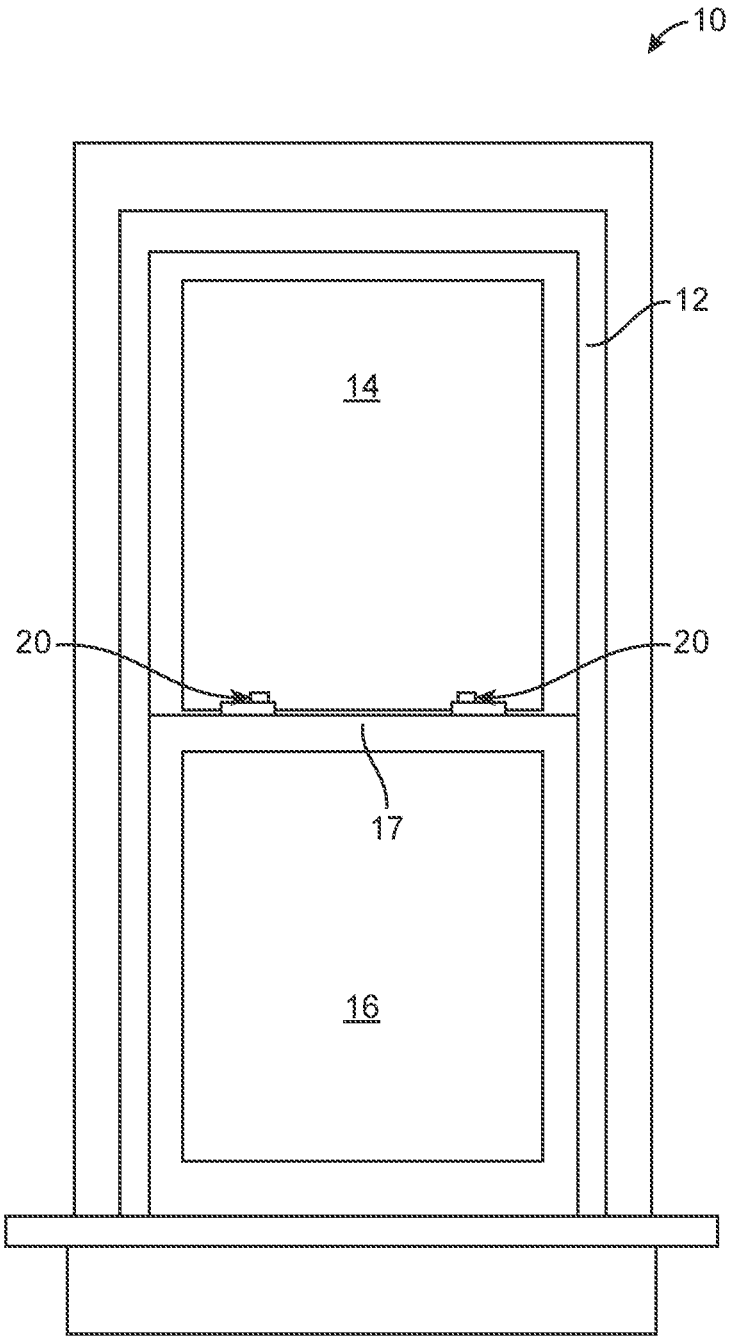
FIG. 1 depicts one illustrative embodiment of a fenestration unit with a movable panel including one illustrative embodiment of a pair of fenestration lock assemblies as described herein in which the movable panel slides within a fenestration unit frame.

In the following description of illustrative embodiments, reference is made to the accompanying figures of the drawing which form a part hereof, and in which are shown, by way of illustration, specific embodiments. It is to be understood that other embodiments may be utilized and structural changes may be made without departing from the scope of the present invention.

The fenestration lock assemblies may be used with a variety of different fenestration units that include movable panels with fenestration lock assemblies. Fenestration units in the form of windows may include one or more horizontally sliding panels (i.e., sashes), one or more vertically moving panels (in, e.g., a double hung window, a single hung window, etc.), and/or one or more rotating panels (in, e.g., a casement window, transom, etc.). Fenestration units in the form of doors may include one or more movable panels, the one or more movable panels may include one or more horizontally sliding panels (e.g., patio doors, sliding doors, gliding doors, multi-glide doors, lift and slide doors, etc.), one or more vertically movable door panels, and/or one or more rotating movable panels. The movable panels in fenestration units as described herein slide and/or rotate between closed and open positions within a fenestration unit frame. The movable panels in fenestration units described herein may include glazing panels and/or opaque panels constructed of wood or other materials.

The illustrative embodiment of fenestration unit 10 depicted in FIG. 1 is in the form of a single or double hung window including a fenestration unit frame 12 along with sashes 14 and 16. In the depicted embodiment of fenestration unit 10, the lower sash 16 carries a pair of illustrative embodiments of fenestration lock assemblies 20 on check rail 17 to lock the sashes 14 and 16 in their closed positions.

Figure 2:
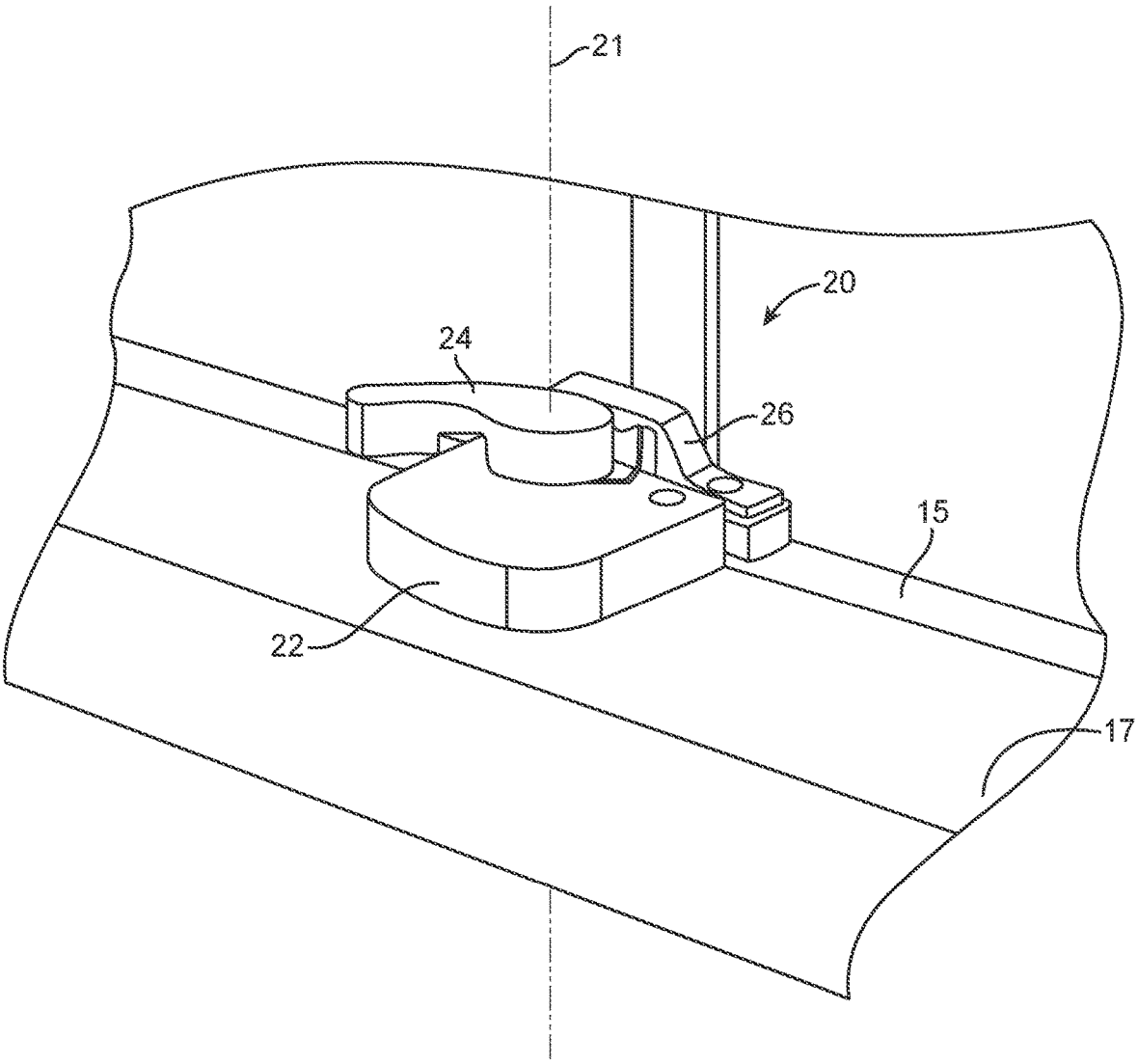
FIG. 2 is a perspective view of a portion of a panel frame member of one illustrative embodiment a movable panel including one of the fenestration lock assemblies depicted in FIG. 1.

One of the fenestration lock assemblies 20 is depicted in an enlarged perspective view in FIG. 2 where the fenestration lock assembly 20 includes a base housing 22 mounted on check rail 17 and a lock element 24 operably connected to the base housing 22 and configured to rotate about axis 21 when moving between its locked and unlocked positions. The lock member 24 is, in the depicted illustrative embodiment, configured to engage with a keeper 26 mounted on check rail 15 that forms a part of the upper sash 14 (see FIG. 1) when the sashes 14 and 16 are in their closed positions and the lock member 24 is in its locked position as seen in FIG. 2. When engaged with the keeper 26, the lock member 24 of the fenestration lock assembly 20 locks the sashes in their closed positions.

In one or more embodiments, all of the components of the fenestration lock assemblies described herein may be located on a check rail and/or within a cavity in a check rail as depicted, e.g., in connection with the illustrative embodiments described herein. In one of more alternative embodiments, the components of the fenestration lock assemblies described herein may be located on and/or in other portions of a fenestration unit, e.g., on and/or in another member used in the fenestration unit (e.g., a top rail, bottom rail, sill, stool., threshold, top/head jamb, side jamb, movable panel, etc.).

Figure 3:
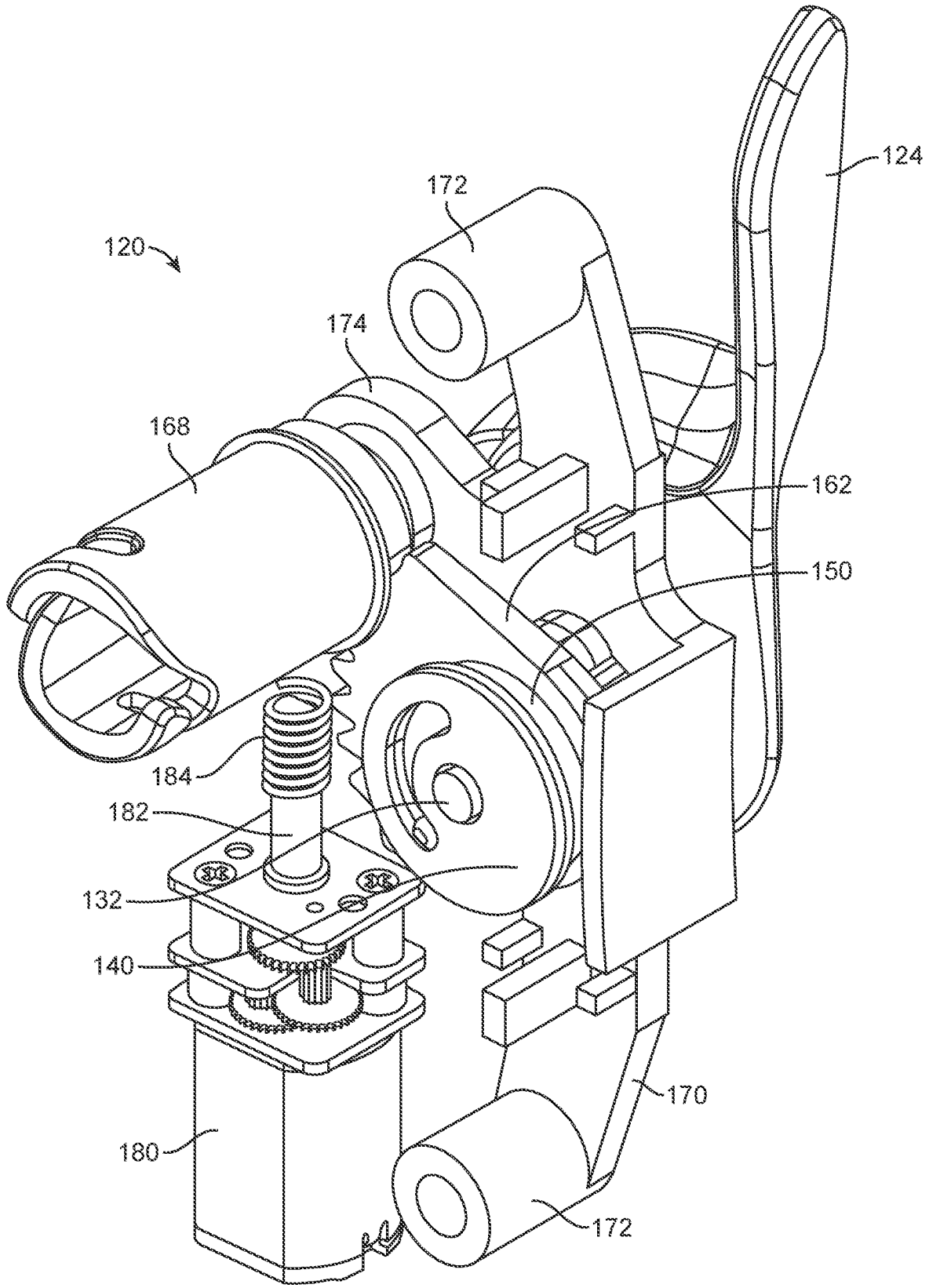
FIG. 3 is a perspective view of one illustrative embodiment of a fenestration lock assembly assembled on a chassis along with a tilt-latch spool and a driving unit positioned to act on the drive gear of the fenestration lock assembly.
Figure 4:
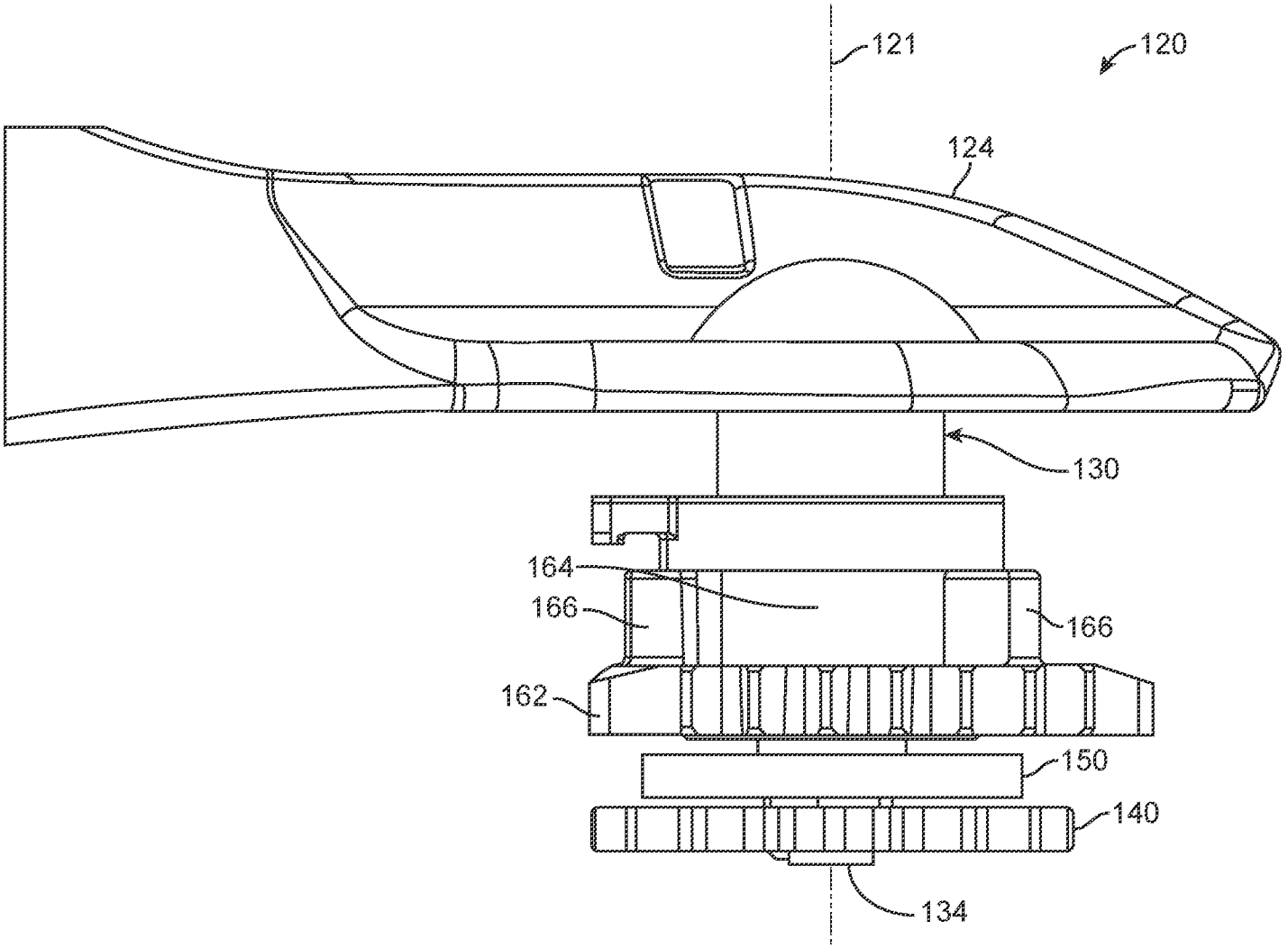
FIG. 4 is an enlarged side view of a portion of the fenestration lock assembly of FIG. 3 as described herein without the motor and removed from the chassis depicted in FIG. 3 for clarity.
Figure 5:
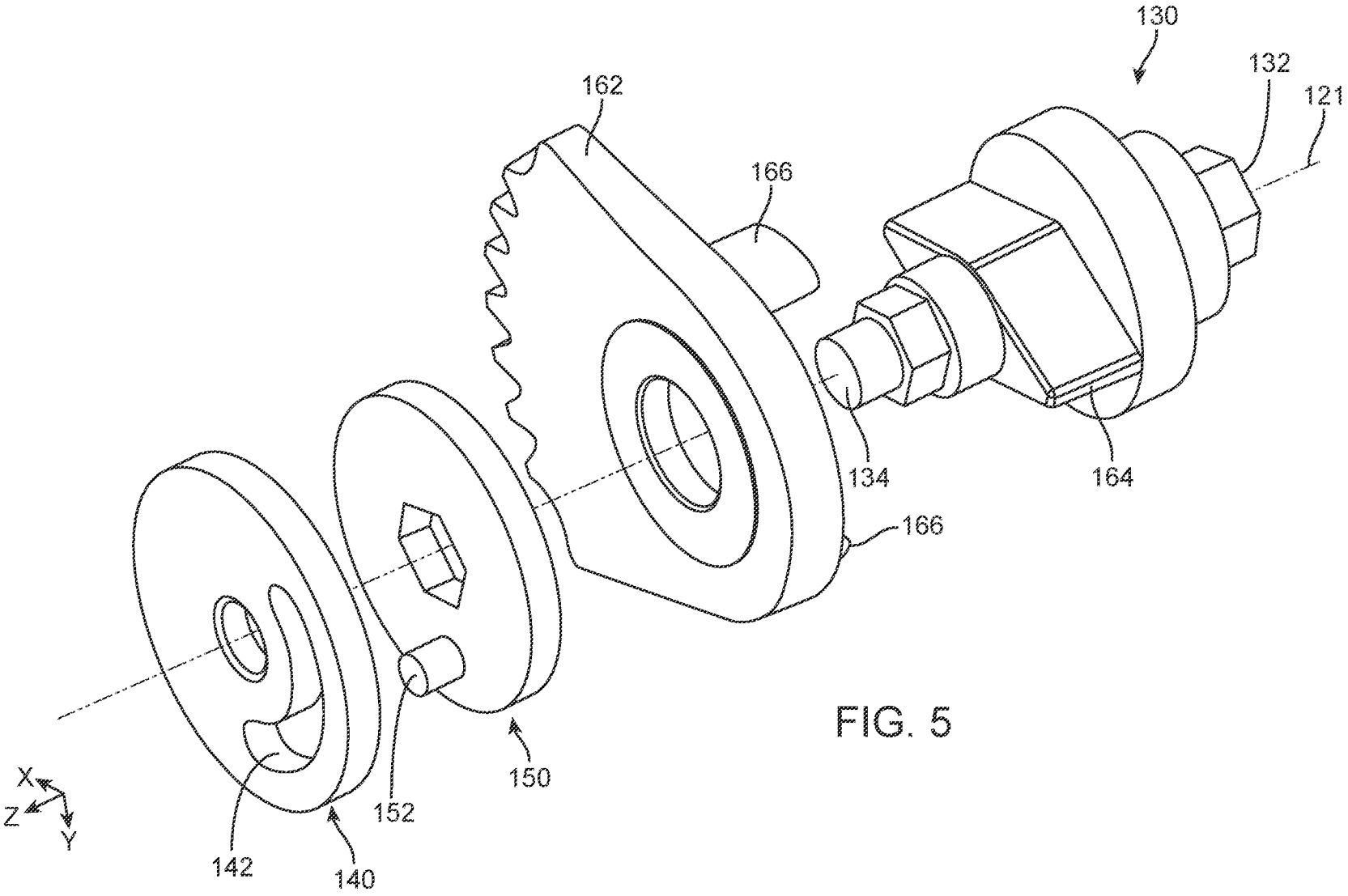
FIG. 5 is an exploded diagram of some of the components of the fenestration lock assembly of FIG. 4.

FIGS. 3-5 include different views of one illustrative embodiment of a fenestration lock assembly as described herein. The fenestration lock assembly 120 is depicted in these figures with one or more components removed for the sake of clarity. For example, the fenestration lock assembly 120 as seen in FIGS. 3-5 does not include a base housing or other cover that would be used to close an opening in which the fenestration lock assembly 120 is installed.

In one or more embodiments, the fenestration lock assemblies described herein may include a chassis 170 to which the remainder of the fenestration lock assembly is attached. The chassis 170 may provide a universal base for the lock assemblies that can be installed in a variety of fenestration units. The chassis 170 includes mounting bosses 172 that may be used to secure the fenestration lock assembly 120 in position on a movable panel (e.g., a sash) and/or may provide for attachment of a wide variety of base housings to cover the opening in which the fenestration lock assembly 120 is installed.

The lock member 124 of the fenestration lock assembly 120 is mounted to a drive shaft 130 along with a drive gear 140, lock follower 150 and tilt-latch actuator 162. The drive shaft 130 is mounted on the chassis 170 for rotation about axis 121 that extends through the drive shaft 130 along its length.

In the depicted illustrative embodiment, an optional tilt latch spool 168 is attached to an arm 174 of the chassis 170. The tilt latch spool 168 can be rotated to operate tilt latches in a window sash as is known in the art (see, e.g., U.S. Pat. Nos. 7,070,211; 7,013,603; 7,322,619; 7,607,262; 7,963,577, etc.). The tilt latch spool may, in the depicted illustrative embodiment, be rotated by a tilt latch spool driver 162 mounted on the drive shaft 130. The depicted illustrative embodiment of drive shaft 130 includes cam 164 (see FIGS. 4-5) that interacts with cam followers 166 on tilt latch spool driver 162. Rotation of the lock member 124 (and the attached drive shaft 130) past the unlock position rotates the spool driver 162 which, in turn, rotates the tilt latch spool 168 to operate tilt latches as discussed in, e.g., U.S. Pat. No. 7,963,577.

A driving unit 180 in the form of a motor having a shaft 182 on which a worm gear 184 is mounted is also provided in the illustrative embodiment of fenestration lock assembly 120 depicted in FIG. 3. Although not shown the chassis 170 may include a mounting arm positioned to allow attachment of the driving unit to the chassis so that the fenestration lock assembly 120 forms a single unit that can be installed in an opening of a movable panel. An electric motor is only one form of a suitable driving unit that can be used in the fenestration lock assemblies described herein. Some potentially suitable alternatives may include, e.g., solenoids, servos, linear actuators, drives, electromagnetic drives, etc. For simplicity, the terms "motor" and "driving unit" are both used herein to generically describe any driving unit capable driving the components of the lock assemblies described herein in the driven mode. Furthermore, although the driving units/motors of fenestration lock assemblies as described herein are described as rotating a drive gear, it should be understood that any suitable connection between the driving unit/motor and the drive gear could be used in a fenestration lock assembly as described herein. For example, the driving unit/motor and drive gear could be mechanically coupled by a belt drive, linkage, tape drive, magnetic coupling, one or more gears and related components, etc. For simplicity, however, the driven member of a fenestration lock assembly as described herein will be generically referred to as a drive gear.

The components of the fenestration lock assembly 120 depicted in FIG. 3 that are attached to the driveshaft 130 are depicted in an enlarged side view in FIG. 4. Those components are also depicted in an exploded diagram in FIG. 5 with the lock member removed from the driveshaft 130.

The driveshaft 130 extends between a first end 132 and a second end 134 with the lock member 124 being attached to the first end 132 of the driveshaft 130 and the drive gear 140 coupled to the driveshaft 130 proximate its second end 134 in the depicted illustrative embodiment seen in FIG. 4. The lock member 124 may be described as being fixedly coupled to the driveshaft 130 such that movement of the lock member 124 between a locked position and an unlocked position rotates the driveshaft 130 over a lock/unlock arc about the drive shaft axis 121. As used herein, the phrase "fixedly coupled" means that rotation of the lock member 124 about the drive shaft axis 121 causes corresponding rotation of the driveshaft 130 about the drive shaft axis 121.

As discussed herein, the depicted illustrative embodiment of driveshaft 130 includes a cam 164 (see, e.g., FIG. 5) that is used to rotate the spool driver 162 by interacting with cam followers 166 projecting from the spool driver 162. These features are, however, as discussed herein, optional and may not be included in a fenestration lock assembly that is not required to also operate tilt latches in a fenestration unit.

The depicted illustrative embodiment of fenestration lock assembly 120 also includes a lock follower 150 that is fixedly coupled to the drive shaft 130 such that movement of the lock member 124 between a locked position and an unlocked position rotates the drive shaft 130 over a lock/unlock arc about the drive shaft axis 121. As a result, rotation of the driveshaft 130 about the drive shaft axis 121 causes corresponding rotation of the fixedly coupled lock follower 150. Further, the lock follower 150, being fixedly coupled to the driveshaft 130, can be described as having a locked configuration corresponding to the locked position of the lock member 124 and an unlocked configuration corresponding to the unlocked position of the lock member 124.

In general, the lock/unlock arc traveled by the lock member 124 in one or more embodiments of a fenestration lock assembly as described herein can be described as including a first end corresponding to the locked position of the lock member 124 and a second end corresponding to the unlocked position of the lock member 124. Rotation of the lock member 124 past the unlocked position can, as described herein, be used to operate tilt latches by rotating a spool driver which, in turn, rotates a tilt latch spool 168 as discussed in connection with FIG. 3.

The illustrative embodiment of fenestration lock assembly 120 as depicted in FIGS. 3-5 also includes a drive gear 140 coupled to the drive shaft 130 between the lock member 150 and the second end 134 of the drive shaft 130. Unlike the lock follower 150 the drive gear 140 is not fixedly coupled to the driveshaft 130. Rather, the drive gear 140 rotates freely about the drive shaft 130. Furthermore, although the drive gear 140 is depicted as being located between the lock follower 150 and the second end 134 of the driveshaft 130, the positions of the lock follower 150 and the drive gear 140 could be reversed in one or more alternative embodiments of fenestration lock assemblies as described herein.

In one or more embodiments of fenestration lock assemblies as described herein, the lock follower 150 and the drive gear 140 may be coupled to each other such that, as described herein, rotation of the driveshaft 130 and the lock follower 150 fixedly coupled to the driveshaft 130 may, under certain circumstances, be freely allowed without moving or rotating the drive gear 140 as a result, the lock follower 150 and driveshaft 130, as well as lock member 124 may be moved between the locked and unlocked states without requiring or causing any movement of the drive gear 140. As discussed herein, this may be beneficial because manual operation of the fenestration lock assembly between its locked and unlocked states can be achieved without requiring any back driving of a motor 180 or other driving unit associated with drive gear 140 as described herein.

In the illustrative embodiment of the fenestration lock assembly 120 depicted in FIGS. 3-5, coupling of the drive gear 140 and the lock follower 150 may be accomplished by a pin and slot combination. In particular, the lock follower 150 may include a pin 152 that extends into an arcuate slot 142 formed in the drive gear 140. The arcuate slot 142 may, in one or more embodiments, extend over the lock/unlock arc as discussed herein such that the pin 152 is free to move within the arcuate slot 142 during manual operation of the fenestration lock assembly without requiring rotation of the drive gear 140 about the drive shaft axis 121.

Figure 6A:
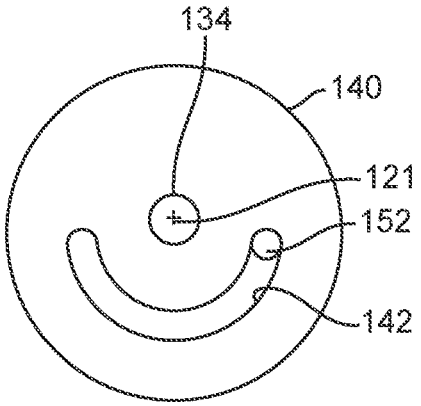
FIGS. 6A-6C are schematic depictions of the drive gear and lock follower arrangement during manual operation of the fenestration lock assembly depicted in FIGS. 3-5 to move the fenestration lock assembly from a locked configuration (FIG. 6A) to an unlocked configuration (FIG. 6B) and back to the locked configuration (FIG. 6A).
Figure 6B:
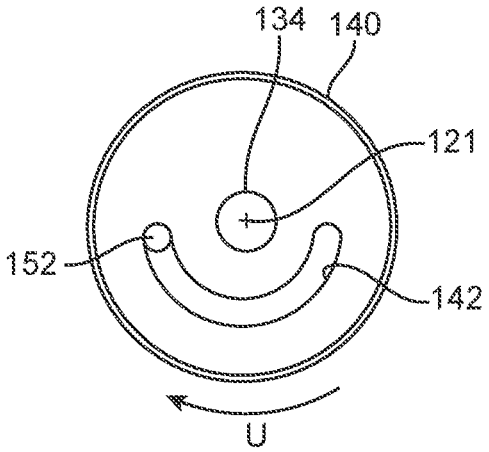
Figure 6C:
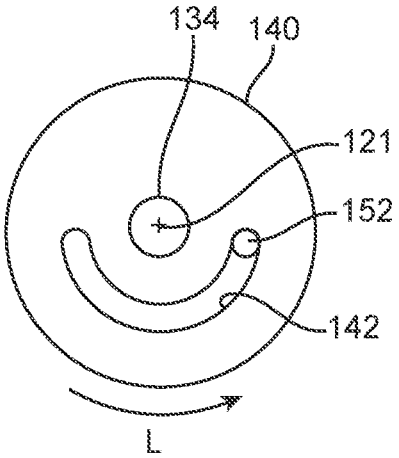

FIGS. 6A-6C are provided to illustrate the positioning of the pin 152 on lock follower 150 relative to the arcuate slot 142 in drive gear 140 during manual operation of the depicted illustrative embodiment of fenestration lock assembly 120. The views depicted in each of FIGS. 6A-6C are taken along the drive shaft axis 121 such that the second end 134 of the driveshaft 130 is visible within the drive gear 140 further, the pin 152 of lock follower 150 is also visible within arcuate slot 142 in drive gear 140.

In each of FIGS. 6A-6C, the drive gear 140 and its arcuate slot 142 can be described as being in the rotational home position relative to the drive shaft axis 121 which, as discussed herein, allows for manual operation of the fenestration lock assembly without requiring movement of the drive gear 140 or any other component used to actively drive the lock assembly between its locked and unlocked states.

With reference to FIG. 6A, the depicted components of the fenestration lock assembly are in the locked configuration with the pin 152 of lock follower 150 being located at one end of arcuate slot 142. Rotation of the locking member 124 attached to the opposite end of the driveshaft 130 in the unlock direction indicated by the arrow "U" in FIG. 6B causes the lock follower 150 to rotate about drive shaft axis 121 in the same direction such that pin 152 moves within arcuate slot 142 to, in the depicted embodiment, the opposite end of the arcuate slot 142 in drive gear 140 as seen in FIG. 6B. As discussed herein, the drive gear 140 and its arcuate slot 142 do not move as the lock follower 150 and its pin 152 rotate about the drive shaft axis 121.

With the lock member 124 of the fenestration lock assembly 120 in its unlocked position, rotation of the lock member 124 in a locking direction that is opposite the unlock direction (as indicated by arrow "L" in FIG. 6C) to move the lock member to its locked position causes the lock follower 150 and its associated pin 152 to also rotate in the locking direction. As a result, the pin 152 of lock follower 150 returns to the opposite end of the arcuate slot 142 in the drive gear 140. Again, rotation of the lock follower 150 and its pin 152 between the unlocked and locked configurations does not require movement of the drive gear 140 out of its rotational home position as discussed herein.

Figure 7A:
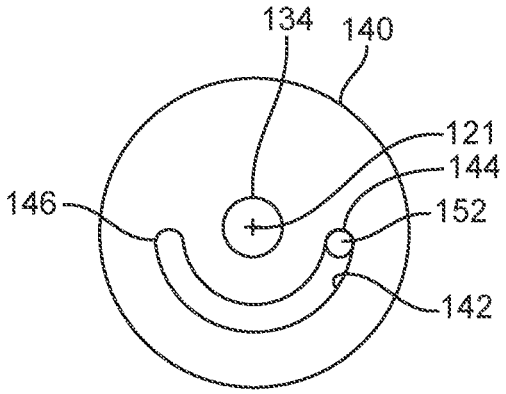
FIGS. 7A-7C are schematic depictions of the drive gear and lock follower arrangement during manual operation of the fenestration lock assembly depicted in FIGS. 3-5 to move the fenestration lock assembly from a locked configuration (FIG. 7A) to an unlocked configuration (FIG. 7B), with the drive gear returning to its rotational home position after moving the lock assembly to the unlocked configuration (FIG. 7C).
Figure 7B:
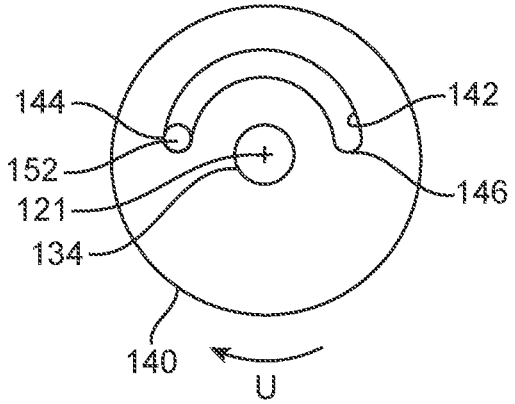
Figure 7C:
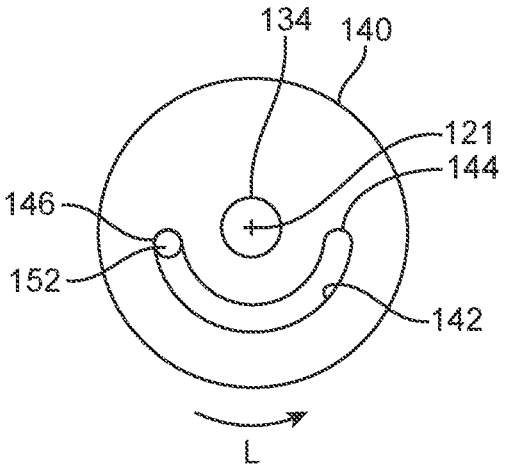

FIGS. 7A-7C are provided to illustrate interactions between the arcuate slot 142 in drive gear 140 and the pin 152 on lock follower 150 during powered or driven operation of the depicted illustrative embodiment of fenestration lock assembly 120. The views depicted in each of FIGS. 7A-7C are taken along the drive shaft axis 121 such that the second end 134 of the driveshaft 130 is visible within the drive gear 140 further, the pin 152 of lock follower 150 is also visible within arcuate slot 142 in drive gear 140.

In each of FIGS. 7A and 7C, the drive gear 140 and its arcuate slot 142 can be described as being in the rotational home position relative to the drive shaft axis 121 which, as discussed herein, allows for manual operation of the fenestration lock assembly without requiring movement of the drive gear 140 or any other component used to actively drive the lock assembly between its locked and unlocked states.

With reference to FIG. 7A, the depicted components of the fenestration lock assembly are in the locked configuration with the pin 152 of lock follower 150 being located at one end of arcuate slot 142. Rotation of the drive gear 140 in the unlock direction indicated by the arrow "U" in FIG. 7B causes the lock follower 150 to rotate about drive shaft axis 121 in the same direction because the end 144 of the arcuate slot 142 acts on the pin 152 as the drive gear 140 rotates. Because the lock follower 150 is fixedly coupled to the driveshaft 130, rotation of the lock follower 150 by the drive gear 140 moves the lock member 124 to its unlocked position.

Referring now to FIG. 7C, after rotating the drive gear 140 in the unlocking direction over the lock/unlock arc to rotate the lock follower 150 to its unlocked configuration as seen in FIG. 7B (which, correspondingly, moves the lock member 124 to its unlocked position), rotation of the drive gear 140 in a locking direction that is opposite the unlock direction (as indicated by arrow "L" in FIG. 7C) causes the drive gear 140 (along with its arcuate slot 142) to move in the locking direction until the drive gear 140 is in its rotational home position as seen in FIG. 7C.

With the lock member 124 in its unlocked position and, correspondingly, the lock follower 150 (along with its pin 152) in the unlocked configuration, movement of the drive gear 140 and its arcuate slot 142 back to the rotational home position as seen in FIG. 7C allows for a user to manually move the lock member 124 in the lock direction such that pin 152 would move through slot 142 from end 146 to end 144 without requiring movement or rotation of the drive gear 140 even after driven operation of the fenestration lock assembly to move the lock member 124 to its unlocked position as described herein.

Figure 8A:
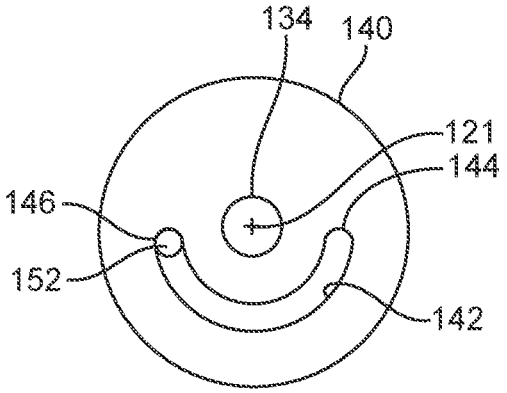
FIGS. 8A-8B are schematic depictions of the drive gear and lock follower arrangement during manual operation of the fenestration lock assembly depicted in FIGS. 3-5 to move the fenestration lock assembly from an unlocked configuration (FIG. 8A) to the locked configuration (FIG. 8B).
Figure 8B:
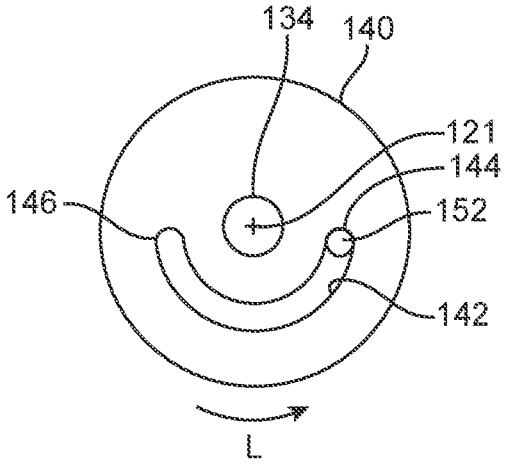

This type of manual operation is depicted in FIGS. 8A and 8B, with the components depicted in FIG. 8A corresponding to the arrangement of the drive gear 140 and lock follower 150 as seen in FIG. 7C. As noted above, movement of the lock member 124 in the lock direction (as indicated by arrow "L" in FIG. 8B) results in movement of the pin 152 through arcuate slot 142 of drive gear 140 without requiring or causing any rotation of drive gear 140 as pin 152 moves through the arcuate slot 142 over the lock/unlock arc from end 146 to end 144.

Figure 9A:
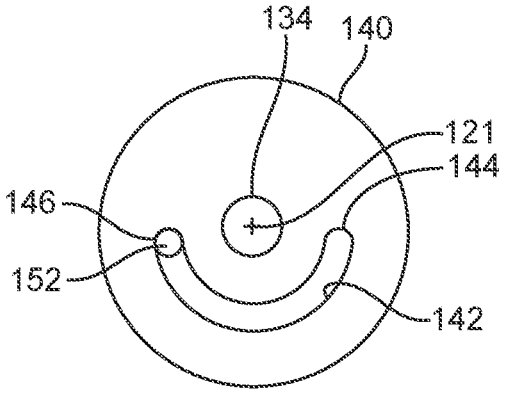
FIGS. 9A-9C are schematic depictions of the drive gear and lock follower arrangement during driven operation of the fenestration lock assembly depicted in FIGS. 3-5 to move the fenestration lock assembly from an unlocked configuration (FIG. 9A) to a locked configuration (FIG. 9B), with the drive gear returning to its rotational home position after moving the lock assembly to the locked configuration (FIG. 9C).
Figure 9B:
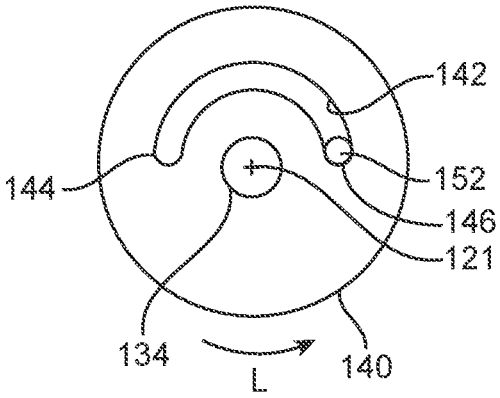
Figure 9C:
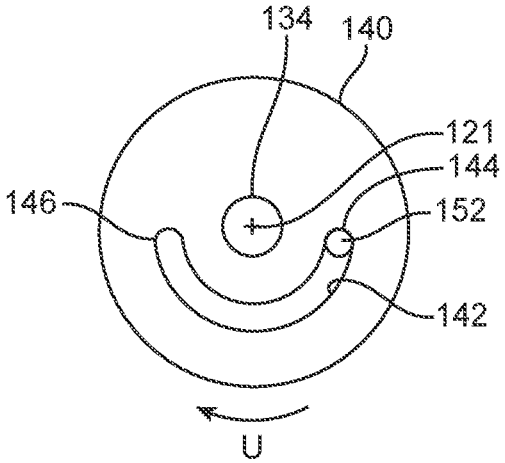

Driven operation of the lock member 124 of the depicted illustrative embodiment of the fenestration lock assembly of FIGS. 3-8B from its unlocked position to its locked position is illustrated in FIGS. 9A-9C. In particular, the pin 152 of lock follower 150 is shown in its unlocked configuration while the arcuate slot 142 of drive gear 140 is in its rotational home position. As a result, pin 152 is located at an end 146 of the arcuate slot 142. Rotation of the drive gear 140 in the lock direction (as indicated by arrow "L" in FIG. 9B) rotates lock follower 150 in the same direction because end 146 of arcuate slot 142 acts on pin 152 of lock follower 152 move pin 152 and its associated lock follower 152 the positions shown in FIG. 9B. In the positions shown in FIG. 9B, the lock follower 150 is in its locked configuration and, correspondingly, the lock member 124 (see, e.g., FIG. 4) is in its locked position.

Although the drive gear 140 could remain in the position seen in FIG. 9B, doing so would require a user who wanted to manually move the lock member 124 to its unlocked position to rotate drive gear 140 in the unlock direction. To avoid requiring a user to manually back drive the drive gear 140 and any associated drive unit operating on the drive gear 140, the drive gear 140 is rotated, in the depicted illustrative embodiment, back in the unlock direction "U" to its rotational home position as seen in, e.g., FIG. 9C. As such, the pin 152 now abuts the end 144 of arcuate slot 142 of drive gear 140. Furthermore, manual operation of the lock assembly to unlock the lock member 124 avoids the need for a user to manually rotate the drive gear 140 in addition to rotating the lock member 124 and its lock follower 150.

Figure 10:
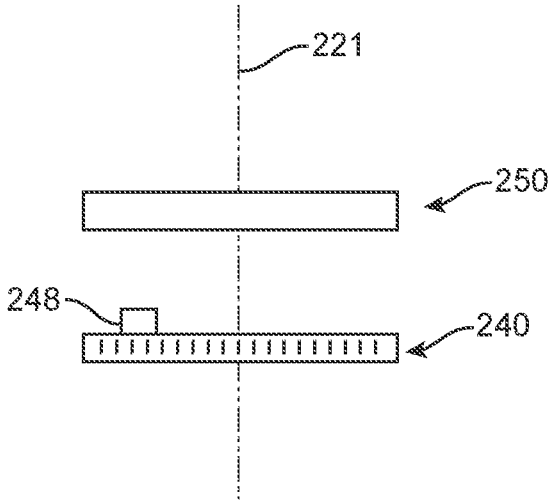
FIG. 10 is an enlarged exploded side view of one alternative embodiment of a lock follower and drive gear that can be used in one or more embodiments of a fenestration lock assembly as described herein.
Figure 11:
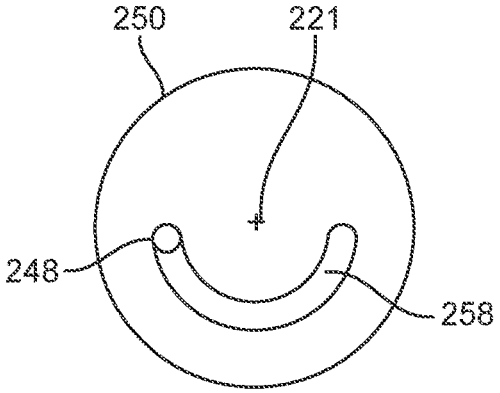
FIG. 11 is an axial view of the lock follower and drive gear of FIG. 10 taken from above the assembly depicted in FIG. 10.

FIGS. 10-11 depict one alternative embodiment of a drive gear 240 and lock follower 250 that may be attached to a drive shaft of a fenestration lock assembly as described herein. In particular, the lock follower 250 is fixedly coupled to a drive shaft of the fenestration lock assembly, while the drive gear 240 is mounted for rotation about the drive shaft axis 221 of the fenestration lock assembly independent of the driveshaft. As a result, rotation of the driveshaft about drive shaft axis 221 rotates the lock follower 250 about the drive shaft axis 221, but rotation of the drive shaft about drive shaft axis 221 does not, alone, cause rotation of the drive gear 240.

In the illustrative embodiment of the drive gear 240 and the lock follower 250, coupling of the drive gear 240 and the lock follower 250 is also accomplished by a pin and slot combination. Unlike drive gear 140 and lock follower 150, however, the drive gear 240 includes a pin 248 that extends into an arcuate slot 258 formed in the lock follower 250. The arcuate slot 258 may, in one or more embodiments, extend over the lock/unlock arc as discussed herein such that the pin 248 is free to move within the arcuate slot 258 during manual operation of the fenestration lock assembly without requiring rotation of the drive gear 240 about the drive shaft axis 221.

Figure 12A:
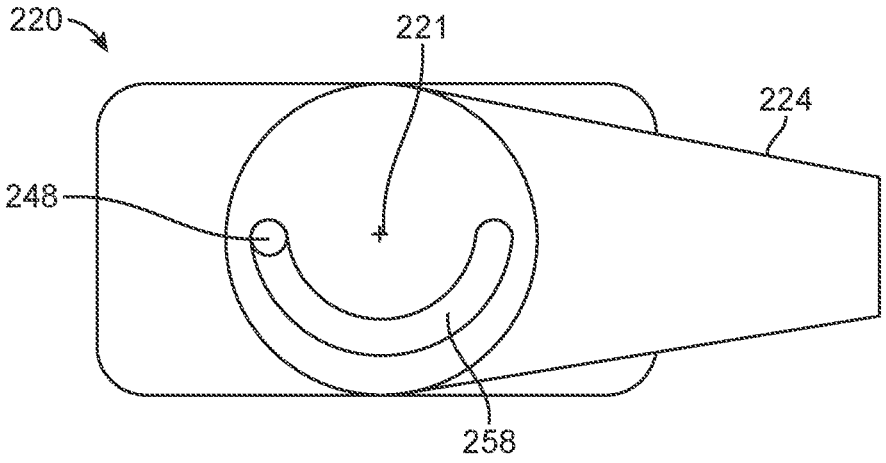
FIGS. 12A-12B are schematic depictions of the drive gear and lock follower arrangement during manual operation of a fenestration lock assembly including the lock follower and drive gear depicted in FIGS. 10-11 to move the fenestration lock assembly from a locked configuration (FIG. 12A) to an unlocked configuration (FIG. 12B).
Figure 12B:
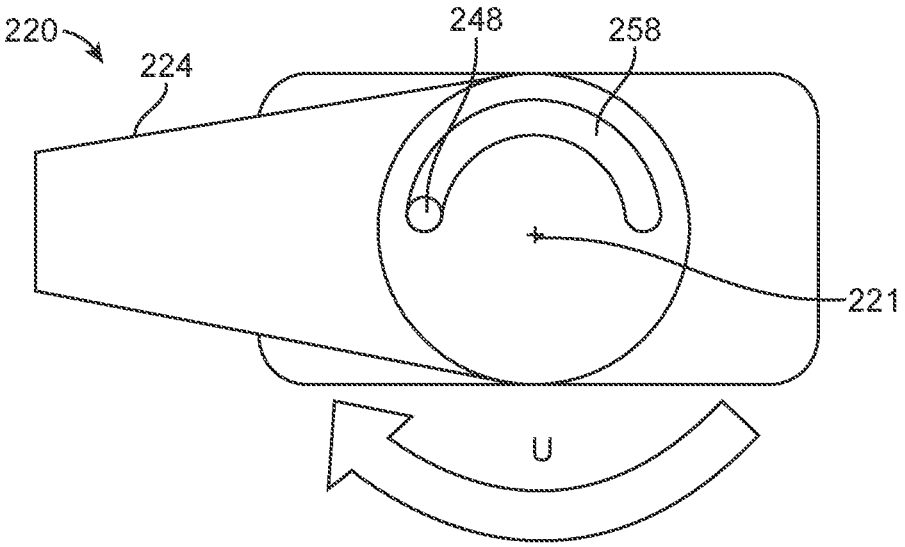

FIGS. 12A-12B are provided to illustrate the positioning of the pin 248 on drive gear 240 relative to the arcuate slot 258 in lock follower 250 during manual operation of the depicted illustrative embodiment of fenestration lock assembly 220. The views depicted in each of FIGS. 12A-12B are taken along the drive shaft axis 221 such that the lock member 224 is closest to the viewer. In other words, the components depicted in FIGS. 12A-12B are seen from the opposite end of the driveshaft as compared to the corresponding components depicted in FIGS. 6A-9B.

The drive gear 240 and its pin 248 can be described as being in the rotational home position relative to the drive shaft axis 221 which, as discussed herein, allows for manual operation of the fenestration lock assembly without requiring movement of the drive gear 248 or any other component used to actively drive the lock assembly between its locked and unlocked states.

With reference to FIG. 12A, the depicted components of the fenestration lock assembly are in the locked configuration with the pin 248 of drive gear 240 being located at one end of arcuate slot 258. Rotation of the locking member 224 attached to the driveshaft in the unlock direction indicated by the arrow "U" in FIG. 12B causes the lock follower 250 to rotate about drive shaft axis 221 in the same direction such that arcuate slot 258 moves along pin 248 (which remains stationary because the drive gear 240 does not rotate with the lock follower 250). At the completion of the unlocking motion, the arcuate slot 258 of the lock follower 250 is positioned such that the pin 248 of the drive gear 240 is in the opposite end of the arcuate slot 258.

In both FIGS. 12A & 12B the drive gear 240 and its associated pin 248 are in the rotational home position as described herein in which the lock member 224 and its lock follower 250 (and associated arcuate slot 258) can be rotated about drive shaft axis 221 between the locked and unlocked positions without requiring movement of the drive gear 240 or any components used to drive the gear during powered or driven operation of the fenestration lock assembly.

Figure 13A:
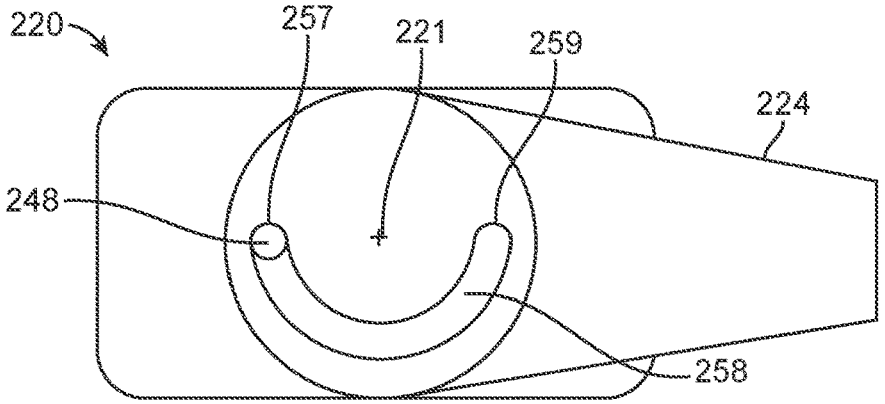
FIGS. 13A-13E are schematic depictions of the drive gear and lock follower arrangement during driven operation of a fenestration lock assembly including the lock follower and drive gear depicted in FIGS. 10-11 to move the fenestration lock assembly from a locked configuration (FIG. 13A) to an unlocked configuration (FIG. 13B), with the drive gear returning to its rotational home position after moving the lock assembly to the unlocked configuration (FIG. 13C), followed by driven operation of the fenestration lock assembly back to the locked configuration (FIG. 13D), and finally completing the locking operation by moving the drive gear back to its rotational home position after driven locking of the fenestration lock assembly (FIG. 13E).
Figure 13B:
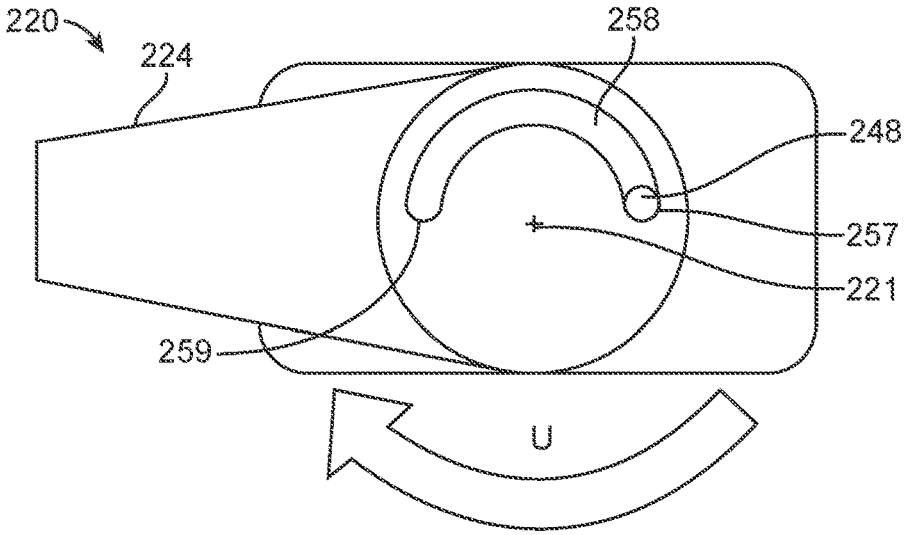
Figure 13C:
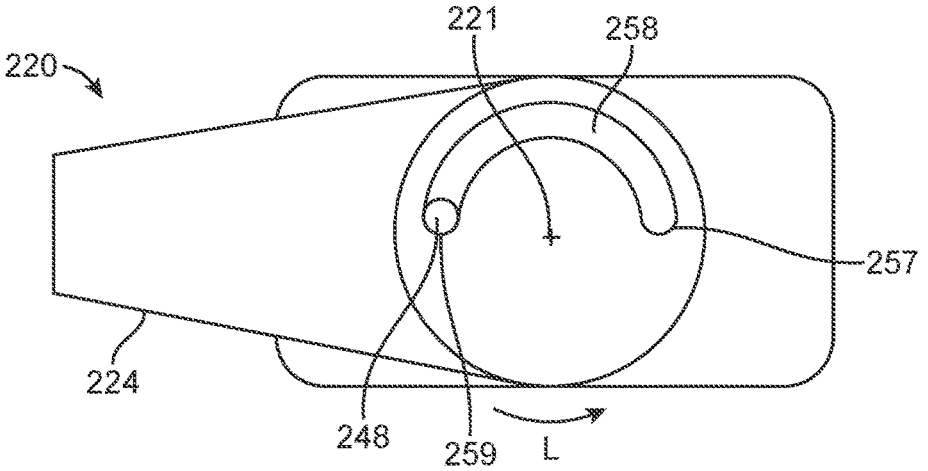

FIGS. 13A-13C are provided to illustrate interactions between the pin 248 of drive gear 240 and the arcuate slot 258 of lock follower 250 during powered or driven operation of the depicted illustrative embodiment of fenestration lock assembly 220. The views depicted in each of FIGS. 13A-13C are taken along the drive shaft axis 221 as discussed above in connection with FIGS. 12A-12B.

In each of FIGS. 13A and 13C, the drive gear 240 and its pin 248 can be described as being in the rotational home position relative to the drive shaft axis 221 which, as discussed herein, allows for manual operation of the fenestration lock assembly without requiring movement of the drive gear 240 or any other component used to actively drive the lock assembly between its locked and unlocked states.

With reference to FIG. 13A, the depicted components of the fenestration lock assembly are in the locked configuration with the pin 248 of the drive gear 240 being located at one end of arcuate slot 258 of the lock follower 250. Rotation of the drive gear 240 in the unlock direction indicated by the arrow "U" in FIG. 13B causes the lock follower 250 and the lock member 224 to rotate about drive shaft axis 221 in the same direction because the pin 248 acts on the end 257 of the arcuate slot 258 as the drive gear 240 and its pin 248 rotate. Because the lock follower 250 is fixedly coupled to the driveshaft, rotation of the lock follower 250 by the drive gear 240 moves the lock member 224 to its unlocked position as seen in FIG. 13B.

Referring now to FIG. 13C, after rotating the drive gear 240 in the unlocking direction over the lock/unlock arc to rotate the lock follower 250 to its unlocked configuration as seen in FIG. 13B (which, correspondingly, moves the lock member 224 to its unlocked position), rotation of the drive gear 240 in a locking direction that is opposite the unlock direction (as indicated by arrow "L" in FIG. 13C) causes the pin 248 to move through arcuate slot 258 in the locking direction until the drive gear 240 and its pin 248 are in the rotational home position as seen in FIG. 13C.

With the lock member 224 in its unlocked position and, correspondingly, the lock follower 250 (along with its arcuate slot 258) in the unlocked configuration, movement of the drive gear 240 and its pin 248 back to the rotational home position as seen in FIG. 13C allows for a user to manually move the lock member 224 in the lock direction such that arcuate slot 258 would move along pin 248 such that the pin moves from end 257 of the slot 258 to end 259 of slot 258 without requiring movement or rotation of the drive gear 240 even after driven operation of the fenestration lock assembly to move the lock member 124 to its unlocked position as described herein.

Figure 13D:
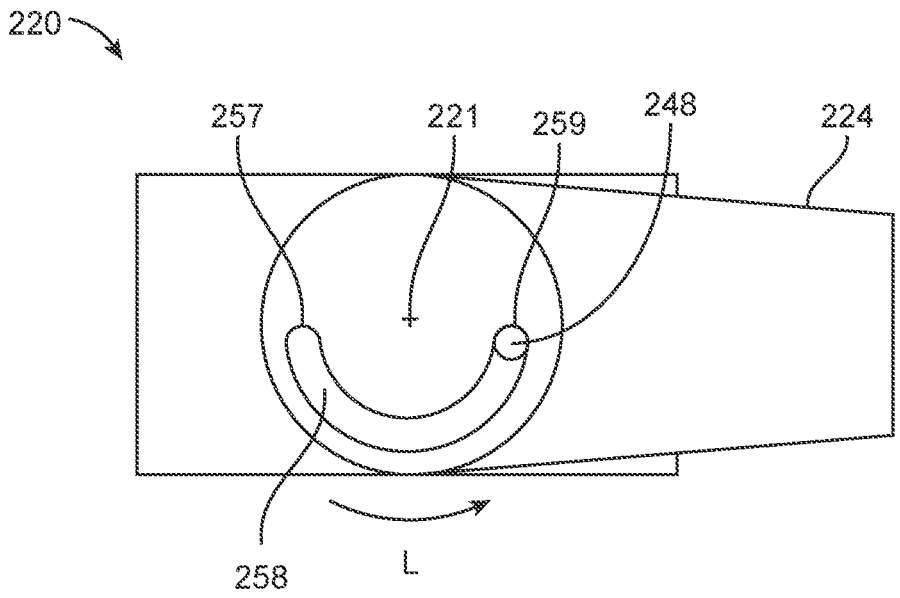
Figure 13E:
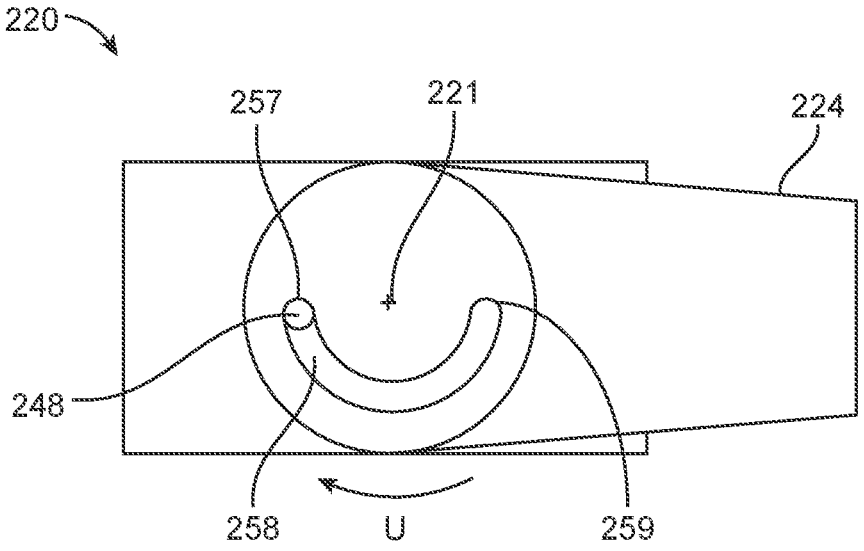

Driven operation of the lock member 224 of the depicted illustrative embodiment of the fenestration lock assembly of FIGS. 10-13C from its unlocked position to its locked position is illustrated in FIGS. 13D-13E. Starting with FIG. 13C, driven operation of the fenestration lock assembly to move the lock member 224 from its unlocked position as seen in FIG. 13C to its locked position as seen in FIG. 13D involves rotating the drive gear 240 (in the direction indicated by arrow "L" in FIG. 13D) such that drive pin 248 acts against end 259 of arcuate slot 258 of lock follower 250. Because lock follower 250 and lock member 224 are both fixedly coupled to the driveshaft, rotation of the lock follower 250 about axis 221 causes corresponding rotation of the lock member 224 to its locked position as seen in FIG. 13D.

Although the drive gear 240 could remain in the position seen in FIG. 13D, doing so would require a user who wanted to manually move the lock member 224 to its unlocked position to rotate drive gear 240 in the unlock direction. To avoid requiring a user to manually back drive the drive gear 240 and any associated drive unit operating on the drive gear 240, the drive gear 240 is rotated, in the depicted illustrative embodiment, back in the unlock direction "U" to its rotational home position as seen in, e.g., FIG. 13E. As such, the pin 248 of drive gear 240 is positioned at the end 257 of arcuate slot 258 of lock follower 250. Furthermore, manual operation of the lock assembly to unlock the lock member 224 when the components are arranged as seen in FIG. 13E avoids the need for a user to manually rotate the drive gear 240 in addition to rotating the lock member 224 and its lock follower 250.

Figure 14:
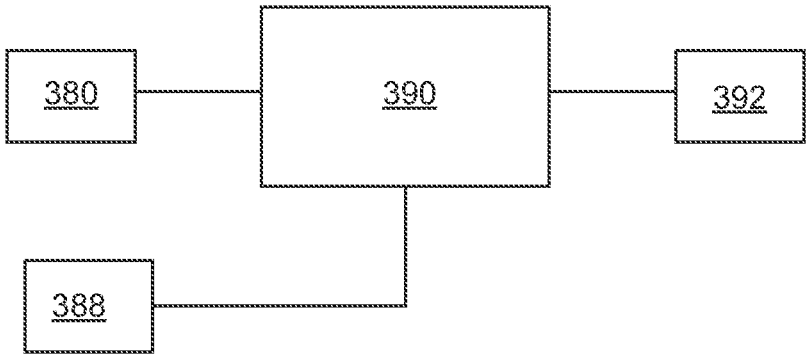
FIG. 14 is a schematic diagram of one illustrative embodiment of a control system that may be used in connection with one or more embodiments of the fenestration lock assemblies described herein.

The fenestration lock assemblies described herein which include a driving unit such as, e.g. a motor, solenoid, etc. may include a control unit that can be used to control locking and unlocking operations of the fenestration lock assembly. One illustrative embodiment of a control unit 390 that may be used in one or more embodiments of a fenestration lock assembly as described herein is depicted in FIG. 14. The control unit 390 may be provided in any suitable form and may, for example, include a power supply (in the form of one or more of, e.g., AC line power, battery and/or solar, capacitive, etc.), memory and a controller. The controller may, for example, be in the form of one or more microprocessors, Field-Programmable Gate Arrays (FPGA), Digital Signal Processors (DSP), microcontrollers, Application Specific Integrated Circuit (ASIC) state machines, etc. The control units may include one or more of any suitable input devices configured to allow a user to operate the drive system (e.g., keyboards, touchscreens, mice, trackballs, buttons, etc.), as well as display devices configured to convey information to a user (e.g., LCD displays, monitors, indicator lights, audible devices (e.g., speakers, buzzers, sirens, etc.) etc.).

In the depicted embodiment, the control unit 390 is connected to various components that may be found in one or more of the fenestration lock assemblies described herein. As depicted in FIG. 14, the control unit 390 is operably connected to the driving unit 380 of a fenestration lock assembly.

In one or more embodiments, the control unit 390 may also be connected to a lock mechanism state sensor 370 configured to monitor whether the fenestration lock assembly is in the locked or unlocked state. Some potentially suitable lock mechanism state sensors and associated components (such as, e.g., power supplies, etc.) may be described in, e.g., U.S. Pat. No. 8,269,627.

Also depicted in FIG. 14 is an optional communication unit 392 which may be used to transmit and/or receive control signals through one or more of mechanical, hydraulic, wired and/or wireless connections (including any suitable electromagnetic signal, light, etc.). Such control signals may include signals used for operation of the drive assemblies and/or signals meant to communicate a status of the drive assemblies and/or lock mechanisms. In one or more alternative embodiments, the communication unit 392 may be configured for wireless control of the driven lock systems as described herein using, e.g., a smart phone or other wireless control device through any suitable wireless communication protocol (including, but not limited to: Bluetooth, ZigBee, a wireless local area network (WLAN), Wi-Fi, RF, etc.).

Although depicted as separate units in FIG. 14, in one or more embodiments the control unit 390 and/or communication unit 392 may be integrated into the driving unit 380 or the lock mechanism state sensor 388. Where the control unit 390 and/or communication unit 392 are provided separately from the driving unit 380 and/or lock mechanism state sensor 388, the control unit 390 and/or communication unit 392 may still be packaged with the fenestration lock assembly such that all of the components, i.e., the control unit 390 and/or communication unit 392 may be located on a chassis or other structure carrying other components of the fenestration lock assembly.

Alternatively, the control unit 390 and/or communication unit 392 may be located remote from the fenestration lock assembly, e.g., on or in a fenestration unit frame carrying the movable panel in which the fenestration lock assembly is located or elsewhere.

The complete disclosure of the patents, patent documents, and publications identified herein are incorporated by reference in their entirety as if each were individually incorporated. To the extent there is a conflict or discrepancy between this document and the disclosure in any such incorporated document, this document will control.

Illustrative embodiments of the fenestration lock assemblies, fenestration units and methods of using the same are discussed herein with some possible variations described. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof. It should also be understood that this invention also may be suitably practiced in the absence of any element not specifically disclosed as necessary herein.

What is claimed is:

1. A fenestration lock assembly comprising:

a drive shaft defining a drive shaft axis extending between a first end and a second end;

a lock member fixedly coupled to the drive shaft proximate the first end of the drive shaft, wherein movement of the lock member between a locked position and an unlocked position rotates the drive shaft over a lock/unlock arc about the drive shaft axis, wherein the lock/unlock arc comprises a first end corresponding to the locked position and a second end corresponding to the unlocked position;

a drive gear coupled to the drive shaft between the lock member and the second end of the drive shaft, wherein the drive gear comprises a rotational home position relative to the drive shaft axis; and a lock follower fixedly coupled to the drive shaft between the lock member and the second end of the drive shaft such that the lock follower rotates with the drive shaft, wherein the lock follower comprises a locked configuration corresponding to the locked position of the lock member and an unlocked configuration corresponding to the unlocked position of the lock member;

wherein the lock follower and the drive gear are coupled to each other such that, when the drive gear is in the rotational home position and the lock follower is in the locked configuration, rotation of the drive gear in an unlock direction over the lock/unlock arc rotates the lock follower and the drive shaft, wherein the lock follower moves to its unlocked configuration and the lock member moves to its unlocked position;

and wherein rotation of the drive shaft and the lock follower about the drive shaft axis between the first end and the second end of the lock/unlock arc does not rotate the drive gear when the drive gear is in the rotational home position.

2. A fenestration lock assembly according to claim 1, wherein, when the lock follower is in its locked configuration and the drive gear is in its rotational home position, rotation of the drive gear in the unlock direction over the lock/unlock arc rotates the lock follower to its unlocked configuration and moves the lock member to its unlocked position through rotation of the drive shaft by the lock follower.

3. A fenestration lock assembly according to claim 1, wherein, when the lock follower is in its unlocked configuration and the drive gear is in its rotational home position, rotation of the drive gear in a lock direction that is opposite the unlock direction over a distance at least as great as the lock/unlock arc rotates the lock follower to its locked configuration and moves the lock member to its locked position through rotation of the drive shaft by the lock follower.

4. A fenestration lock assembly according to claim 1, wherein the assembly comprises a controller operably connected to a motor that is operably connected to the drive gear, wherein the controller is configured to operate the motor such that the motor rotates the drive gear about the drive shaft axis.

5. A fenestration lock assembly according to claim 4, wherein the controller is configured to operate the motor such that the drive gear returns to its rotational home position after motor rotates the drive gear in the unlocking direction over the lock/unlock arc to rotate the lock follower and the drive shaft such that the lock follower moves to its unlocked configuration and the lock member moves to its unlocked position.

6. A fenestration lock assembly according to claim 4, wherein the controller is configured to operate the motor such that the drive gear returns to its rotational home position after the motor rotates the drive gear in the lock direction to rotate the lock follower to its locked configuration and move the lock member to its locked position through rotation of the drive shaft by the lock follower.

7. A fenestration lock assembly according to claim 1, wherein the lock follower comprises a pin and the drive gear comprises an arcuate slot occupying a slot arc at least as large as the lock/unlock arc, and wherein the pin is located in the arcuate slot, wherein the pin moves within the arcuate slot when the lock member is moved between the locked position and the unlocked position and the drive gear is stationary in its rotational home position.

8. A fenestration lock assembly according to claim 7, wherein, when the drive gear is in the rotational home position and the lock follower is in the locked configuration, rotation of the drive gear in an unlocking direction over the lock/unlock arc moves the arcuate slot and the pin to rotate the lock follower and the drive shaft, wherein the lock follower moves to its unlocked configuration and the lock member moves to its unlocked position.

9. A fenestration lock assembly according to claim 8, wherein, after rotating the drive gear in the unlocking direction over the lock/unlock arc to rotate the lock follower to its unlocked configuration and move the lock member to its unlocked position, rotation of the drive gear in a locking direction that is opposite the unlocking direction moves the arcuate slot and the pin to rotate the lock follower and the drive shaft, wherein the lock follower moves to its locked configuration and the lock member moves to its locked position.

10. A fenestration lock assembly according to claim 1, wherein the drive gear comprises a pin and the lock follower comprises an arcuate slot occupying a slot arc at least as large as the lock/unlock arc, and wherein the pin is located in the arcuate slot, wherein the arcuate slot moves along the pin when the lock member is moved between the locked position and the unlocked position and the drive gear is stationary in its rotational home position.

11. A fenestration lock assembly according to claim 10, wherein, when the drive gear is in the rotational home position and the lock follower is in the locked configuration, rotation of the drive gear in an unlocking direction over the lock/unlock arc moves the arcuate slot and the pin to rotate the lock follower and the drive shaft, wherein the lock follower moves to its unlocked configuration and the lock member moves to its unlocked position.

12. A fenestration lock assembly according to claim 11, wherein, after rotating the drive gear in the unlocking direction over the lock/unlock arc to rotate the lock follower to its unlocked configuration and move the lock member to its unlocked position followed by moving the drive gear to its rotational home position, the lock follower can be moved to its locked configuration and the lock member moved to its locked position by rotating the drive gear in a locking direction that is opposite the unlocking direction such that the pin acts against an end of the arcuate slot to rotate the lock follower to its locked configuration.

13. A fenestration unit comprising:

a frame defining opening within the frame, a movable panel mounted in the frame, wherein the movable panel is configured for movement within the frame between a closed position in which the opening is closed, and an open position in which the opening is open; and a fenestration lock assembly operably attached to the fenestration unit, wherein the fenestration lock assembly comprises a fenestration lock assembly as recited in claim 1.

14. A method of operating a fenestration lock, wherein the fenestration lock comprises a fenestration lock assembly including: a drive shaft defining a drive shaft axis extending between a first end and a second end; a lock member fixedly coupled to the drive shaft proximate the first end of the drive shaft, wherein movement of the lock member between a locked position and an unlocked position rotates the drive shaft over an lock/unlock arc about the drive shaft axis, wherein the lock/unlock arc comprises a first end corresponding to the locked position and a second end corresponding to the unlocked position; a drive gear coupled to the drive shaft between the lock member and the second end of the drive shaft, wherein the drive gear comprises a rotational home position relative to the drive shaft axis; and a lock follower fixedly coupled to the drive shaft between the lock member and the second end of the drive shaft such that the lock follower rotates with the drive shaft, wherein the lock follower comprises a locked configuration corresponding to the locked position of the lock member and an unlocked configuration corresponding to the unlocked position of the lock member, the method comprising:

manually moving the lock member from its locked position to its unlocked position, wherein moving the lock member from its locked position to its unlocked position rotates the drive shaft and the lock follower in an unlock direction about the drive shaft axis between the first end and the second end of the lock/unlock arc while the drive gear remains in its rotational home position, wherein manually moving the lock member from its locked position to its unlocked position moves the lock follower to its unlocked configuration;

manually moving the lock member from its unlocked position to its locked position, wherein moving the lock member from its unlocked position to its locked position rotates the drive shaft and the lock follower in a lock direction about the drive shaft axis between the first end and the second end of the lock/unlock arc while the drive gear remains in its rotational home position, wherein manually moving the lock member from its unlocked position to its locked position moves the lock follower to its locked configuration;

driving the lock member from its locked position to its unlocked position by driving the drive gear out of its rotational home position in the unlock direction when the lock follower is in its locked configuration, wherein the drive gear is driven using a motor operably coupled to the drive gear, and wherein driving the drive gear out of its rotational home position in the unlock direction rotates the lock follower and the drive shaft in the unlock direction about the drive shaft axis between the first end and the second end of the lock/unlock arc; and driving the lock member from its unlocked position to its locked position by driving the drive gear out of its rotational home position in the lock direction when the lock follower is in its unlocked configuration, wherein the drive gear is driven using a motor operably coupled to the drive gear, and wherein driving the drive gear out of its rotational home position in the lock direction rotates the lock follower and the drive shaft in the lock direction about the drive shaft axis between the first end and the second end of the lock/unlock arc.

15. A method according to claim 14, wherein the method further comprises using the motor to drive the drive gear back to its home position after driving the drive gear out of its rotational home position in the unlock direction to drive the lock member from its locked position to its unlocked position.

16. A method according to claim 15, wherein driving the drive gear back to its home position comprises rotating the drive gear in the lock direction.

17. A method according to claim 14, wherein the method further comprises using the motor to drive the drive gear back to its home position after driving the drive gear out of its rotational home position in the lock direction to drive the lock member from its unlocked position to its locked position.

18. A method according to claim 17, wherein driving the drive gear back to its home position after driving the drive gear out of its rotational home position in the lock direction to drive the lock member from its unlocked position to its locked position comprises rotating the drive gear in the unlock direction.

19. A method according to claim 14, wherein the lock follower comprises a pin and the drive gear comprises an arcuate slot occupying a slot arc at least as large as the lock/unlock arc, and wherein the pin is located in the arcuate slot, wherein manually moving the lock member from the locked position and the unlocked position when the drive gear is stationary in its rotational home position moves the pin within the arcuate slot.

20. A method according to claim 19, wherein driving the drive gear out of its rotational home position in the unlock direction when the drive gear is in the rotational home position and the lock follower is in the locked configuration moves the arcuate slot and the pin to rotate the lock follower to its unlocked configuration.

21. A method according to claim 19, wherein driving the drive gear out of its rotational home position in the lock direction when the drive gear is in the rotational home position and the lock follower is in the unlocked configuration moves the arcuate slot and the pin to rotate the lock follower to its locked configuration.

22. A method according to claim 14, wherein the drive gear comprises a pin and the lock follower comprises an arcuate slot occupying a slot arc at least as large as the lock/unlock arc, and wherein the pin is located in the arcuate slot, wherein manually moving the lock member from the locked position and the unlocked position when the drive gear is stationary in its rotational home position moves the arcuate slot about the drive shaft axis while the pin remains in a fixed position relative to the drive shaft axis.

23. A method according to claim 22, wherein driving the drive gear out of its rotational home position in the unlock direction when the drive gear is in the rotational home position and the lock follower is in the locked configuration moves the pin against a first end of the arcuate slot to rotate the lock follower to its unlocked configuration.

24. A method according to claim 22, wherein driving the drive gear out of its rotational home position in the lock direction when the drive gear is in the rotational home position and the lock follower is in the unlocked configuration moves the pin against a second end of the arcuate slot to rotate the lock follower to its locked configuration.

* * * * *